US008826700B2

(12) United States Patent
Kim

(10) Patent No.: US 8,826,700 B2
(45) Date of Patent: Sep. 9, 2014

(54) DETERGENT SUPPLY APPARATUS AND WASHING MACHINE HAVING THE SAME

(75) Inventor: Jin Doo Kim, Gyionggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 986 days.

(21) Appl. No.: 12/926,162

(22) Filed: Oct. 28, 2010

(65) Prior Publication Data

US 2011/0120196 A1 May 26, 2011

(30) Foreign Application Priority Data

Nov. 24, 2009 (KR) ..... 10-2009-113644

(51) Int. Cl.
*D06F 39/02* (2006.01)

(52) U.S. Cl.
CPC ..... *D06F 39/022* (2013.01); *D06F 39/02* (2013.01)
USPC ..... 68/17 R

(58) Field of Classification Search
CPC ..... D06F 39/022; D06F 39/02
USPC ..... 68/17 R; 134/93, 100; 137/268; 422/264, 266, 277
See application file for complete search history.

(56) References Cited

U.S. PATENT DOCUMENTS 6,826,933 B2 * 12/2004 Merkle et al. ..... 68/17 R
7,249,473 B2 * 7/2007 Rizzeto et al. ..... 68/17 R
2005/0229652 A1 10/2005 Kim et al.
2007/0044517 A1 * 3/2007 Yang et al. ..... 68/17 R
2009/0100880 A1 4/2009 Hill

FOREIGN PATENT DOCUMENTS

| | | |
|---|---|---|
| EP | 1 350 882 | 10/2003 |
| JP | 2004-8277 | 1/2004 |
| KR | 10-2007-0027932 | 3/2007 |

OTHER PUBLICATIONS

European Search report dated Apr. 27, 2011, issued in European Application No. 10189742.9.

* cited by examiner

*Primary Examiner* — Joseph L Perrin
(74) *Attorney, Agent, or Firm* — Staas & Halsey LLP

(57) ABSTRACT

A detergent supply apparatus and a washing machine having the same wherein residual water is not present in a liquid detergent containing unit. The detergent supply apparatus includes a detergent box and at least one liquid detergent containing unit provided in the detergent box to move a liquid detergent using a siphon phenomenon. The liquid detergent containing unit includes a siphon pipe to induce a siphon action, a siphon cap coupled to the siphon pipe, and at least one residual water hole formed through a bottom of the liquid detergent containing unit. The siphon cap includes at least one cap protrusion configured to be fitted into the residual water hole. A gap is defined between the residual water hole and the cap protrusion such that residual water is discharged from the liquid detergent containing unit through the gap.

22 Claims, 9 Drawing Sheets

DETERGENT SUPPLY APPARATUS AND WASHING MACHINE HAVING THE SAME

CROSS-REFERENCE TO RELATED APPLICATIONS

This application claims the benefit of Korean Patent Application No. 2009-0113644, filed on Nov. 24, 2009 in the Korean Intellectual Property Office, the disclosure of which is incorporated herein by reference.

BACKGROUND

1. Field

Embodiments relate to a detergent supply apparatus and a washing machine having the same wherein residual water is not present in a liquid detergent containing unit.

2. Description of the Related Art

Generally, a washing machine agitates laundry, wash water and a detergent in a washing tub using drive force of a motor to perform washing through friction therebetween.

The washing machine may include a detergent supply apparatus to supply a detergent to water to be supplied into a water tub such that the mixture of the detergent and the water is supplied into the water tub.

The detergent supply apparatus may include a detergent box, the interior of which is partitioned into sections such that different kinds of detergents are contained in the respective sections.

Also, a liquid detergent containing unit to contain a liquid detergent may be provided in the detergent box. The liquid detergent containing unit moves the liquid detergent diluted in the water using a siphon phenomenon. The liquid detergent containing unit may include a siphon pipe to induce a siphon action and a siphon cap coupled to the siphon pipe.

However, the siphon phenomenon occurs only at a predetermined level. Therefore, residual water is present in the liquid detergent containing unit at a level below the predetermined level.

Also, steam generated during steam washing or drying may be collected in the liquid detergent containing unit.

SUMMARY

It is an aspect to provide a detergent supply apparatus and a washing machine having the same wherein residual water is not present in a liquid detergent containing unit.

It is another aspect to provide a detergent supply apparatus and a washing machine having the same wherein the interior of a liquid detergent containing unit is kept clean.

Additional aspects will be set forth in part in the description which follows and, in part, will be apparent from the description, or may be learned by practice of the invention.

In accordance with one aspect, a detergent supply apparatus includes a detergent box and at least one liquid detergent containing unit provided in the detergent box to move a liquid detergent using a siphon phenomenon, wherein the liquid detergent containing unit includes a siphon pipe to induce a siphon action, a siphon cap coupled to the siphon pipe, and at least one residual water hole formed through a bottom of the liquid detergent containing unit, the siphon cap includes at least one cap protrusion configured to be fitted into the residual water hole, and at least one gap is defined between the residual water hole and the cap protrusion such that residual water is discharged from the liquid detergent containing unit through the gap.

The cap protrusion may protrude downward along part of a circumference of the siphon cap, and the residual water hole may have a shape corresponding to and greater than that of the cap protrusion.

The gap may be defined between at least one outer side of the cap protrusion and at least one inner side of the residual water hole.

The siphon pipe may be disposed at a center of a siphon installation part protruding downward from the bottom of the liquid detergent containing unit, and the residual water hole may be disposed at the siphon installation part at which the cap protrusion is mounted.

The gap may have a size of about 0.05 mm to about 0.5 mm.

The cap protrusion may have a length of about 3 mm to about 7 mm between opposite ends thereof.

The siphon pipe may protrude downward from the bottom of the liquid detergent containing unit to accelerate the siphon action.

The liquid detergent containing unit may include a separation type liquid detergent containing unit detachably provided in the detergent box.

The separation type liquid detergent containing unit may contain a main washing liquid detergent.

The liquid detergent containing unit may include at least one integral liquid detergent containing unit integrally provided in the detergent box.

The integral liquid detergent containing unit may include a main washing liquid detergent containing unit to contain a main washing liquid detergent, the siphon cap may include a cap liquid unit coupled to the siphon pipe, and the cap liquid unit may include a unit body having a supply hole to inject a liquid detergent, a first siphon cap provided at a bottom of the unit body, the first siphon cap being coupled to the siphon pipe, and a foreign matter filter extending downward from one end of the unit body.

The integral liquid detergent containing unit may include a rinse containing unit to contain a rinse or a decolorant, the siphon cap may include a rinse cap coupled to the siphon pipe, the rinse cap may include a rinse injection unit to inject a rinse and a reserve detergent containing unit to contain a reserve detergent, and the rinse injection unit may include a second siphon cap provided at a bottom thereof, the second siphon cap being coupled to the siphon pipe.

The reserve detergent containing unit may be integrally formed at a rear of the rinse cap.

In accordance with another aspect, a washing machine includes a cabinet, a detergent box detachably coupled into one side of the cabinet, and at least one liquid detergent containing unit provided in the detergent box to move a liquid detergent using a siphon phenomenon, wherein the liquid detergent containing unit includes a siphon pipe to induce a siphon action, a siphon cap coupled to the siphon pipe, and a residual water removal unit to remove residual water from the liquid detergent containing unit, the residual water removal unit includes at least one residual water hole formed through a bottom of the liquid detergent containing unit, at least one cap protrusion provided at the siphon cap such that the cap protrusion is fitted into the residual water hole, and at least one residual water discharge unit formed between the residual water hole and the cap protrusion to function as a discharge channel through which residual water is discharged.

The cap protrusion may protrude downward along part of a circumference of the siphon cap, and the residual water hole may have a shape corresponding to and greater than that of the cap protrusion.

The residual water discharge unit may be formed between at least one outer side of the cap protrusion and at least one inner side of the residual water hole.

A gap defined between at least one inner side of the residual water hole and at least one outer side of the cap protrusion may have a size of about 0.05 mm to about 0.5 mm.

The cap protrusion may have a length of about 3 mm to about 7 mm between opposite ends thereof.

The siphon pipe may protrude downward from the bottom of the liquid detergent containing unit to accelerate the siphon action.

In accordance with another aspect, a detergent supply apparatus includes a detergent box and at least one liquid detergent containing unit provided in the detergent box to move a liquid detergent using a siphon phenomenon, wherein the liquid detergent containing unit includes a siphon pipe to induce a siphon action, a siphon cap coupled to the siphon pipe, and a water selection unit to select only water such that only the water passes therethrough, and the water selection unit includes at least one selection hole formed through a bottom of the liquid detergent containing unit, at least one cap protrusion configured to be fitted into the selection hole, and at least one selection gap unit formed between the selection hole and the cap protrusion such that only the water passes therethrough.

The cap protrusion may protrude downward along part of a circumference of the siphon cap, and the selection hole may have a sectional shape corresponding to and greater than that of the cap protrusion.

The selection gap unit may be formed between at least one outer side of the cap protrusion and at least one inner side of the selection hole.

A gap defined between the inner side of the selection hole and the outer side of the cap protrusion may have a size of about 0.05 mm to about 0.5 mm.

In accordance with a further aspect, a detergent supply apparatus includes a detergent box and at least one liquid detergent containing unit provided in the detergent box to move a liquid detergent using a siphon phenomenon, wherein the liquid detergent containing unit includes at least one residual water hole formed through a bottom thereof and at least one hole insertion part configured to be inserted into the residual water hole, and at least one gap is defined between the residual water hole and the hole insertion part such that residual water is discharged from the liquid detergent containing unit through the gap.

The residual water hole may have a sectional shape corresponding to and greater than that of the hole insertion part.

The gap may be defined between at least one outer side of the hole insertion part and at least one inner side of the residual water hole.

The gap may have a size of about 0.05 mm to about 0.5 mm.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
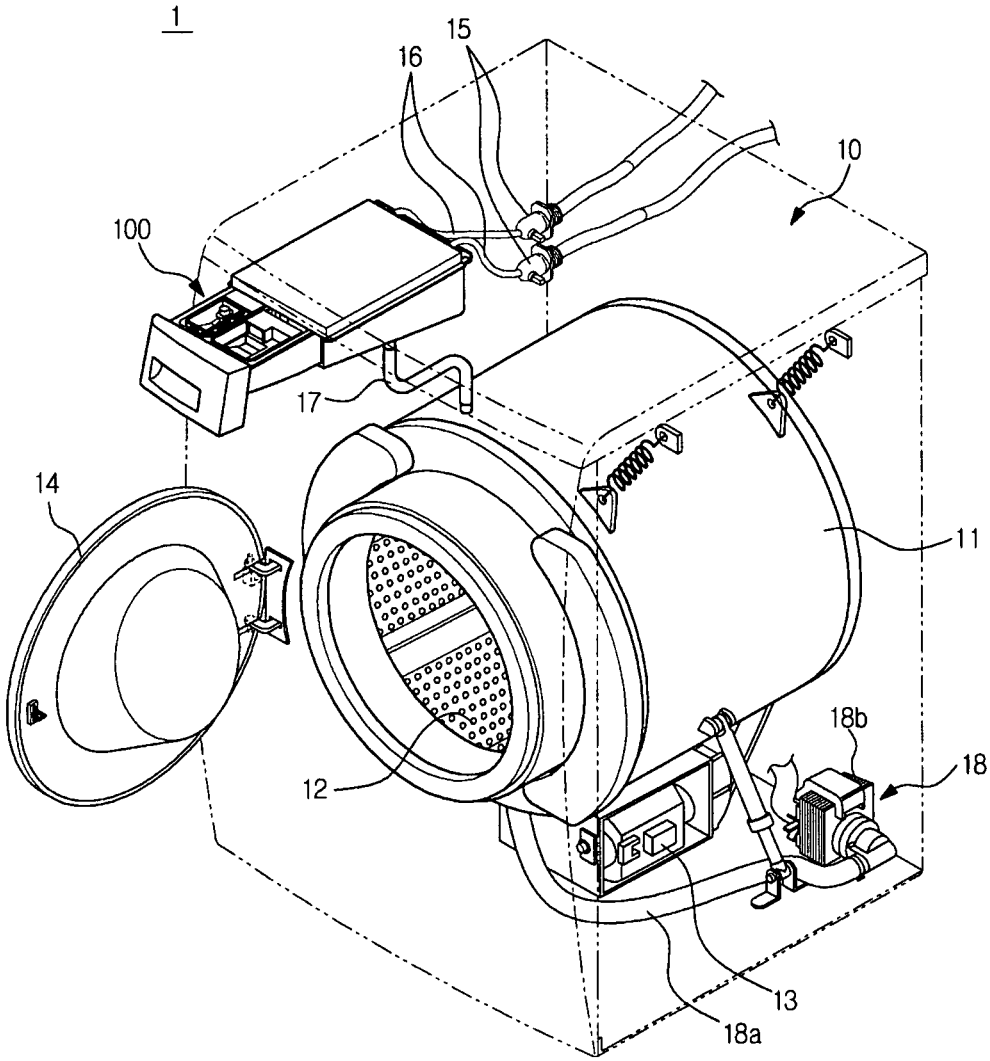
FIG. 1 is a perspective view illustrating a drum washing machine according to an embodiment.

Reference will now be made in detail to the embodiments, examples of which are illustrated in the accompanying drawings, wherein like reference numerals refer to like elements throughout.

Figure 2:
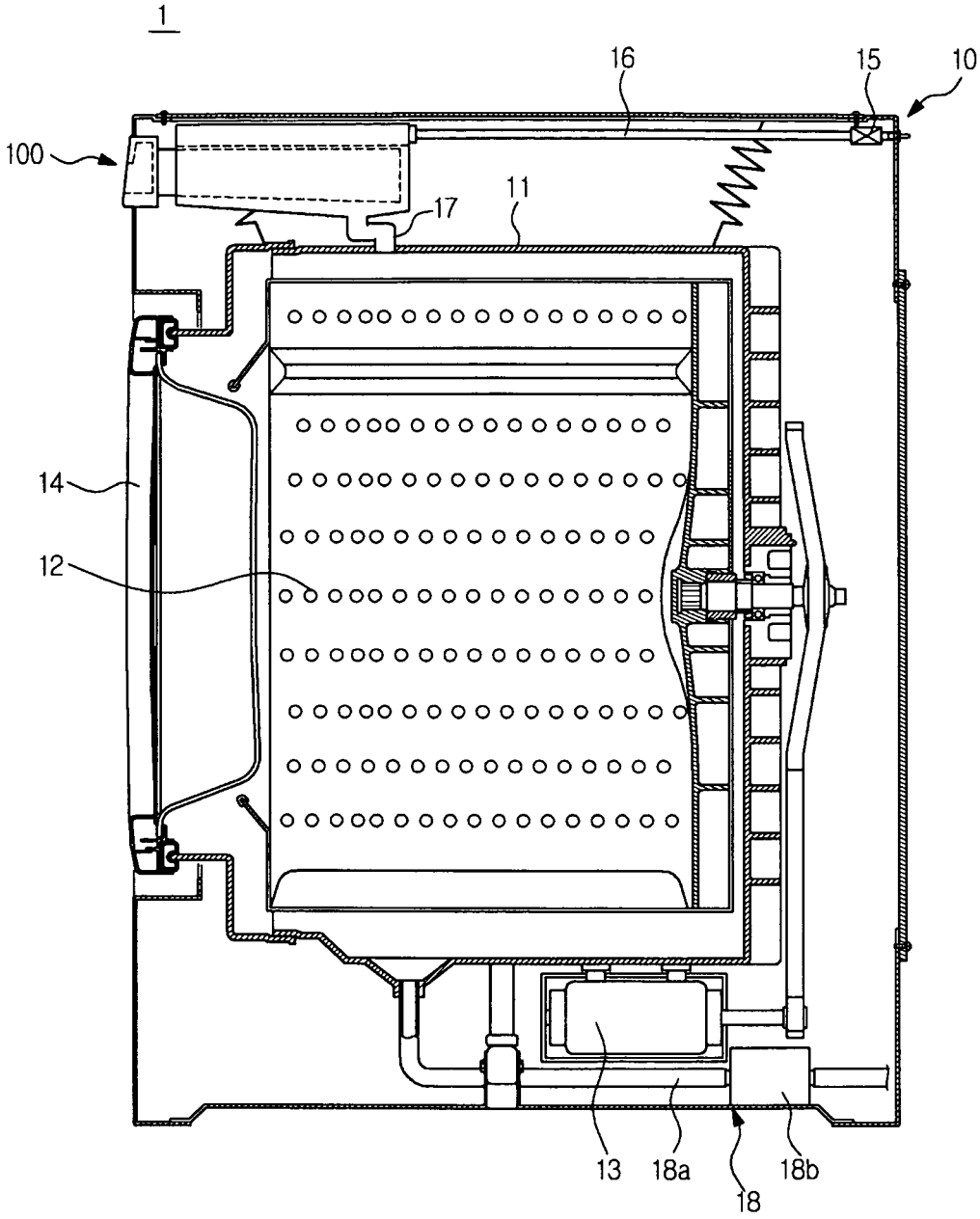
FIG. 2 is a side sectional view of the drum washing machine of FIG. 1.

FIG. 1 is a perspective view illustrating a drum washing machine 1 according to an embodiment. FIG. 2 is a side sectional view of the drum washing machine 1 of FIG. 1.

As shown in FIGS. 1 and 2, the drum washing machine 1 includes a cabinet 10 forming the external appearance thereof, a tub 11 mounted in the cabinet 10 to contain wash water, a cylindrical drum 12 rotatably mounted in the tub 11, the drum 12 having a plurality of spin-drying holes formed at a wall thereof, and a drive motor to rotate the drum 12 in alternating directions such that washing, rinsing and spin-drying operations are performed in the drum 12.

At the tub 11 and the drum 12 are formed openings through which laundry is introduced or removed in front of the cabinet 10. To the front of the cabinet 10 is hingedly coupled a door 14 to open and close the openings.

At the rear of the cabinet 10 is mounted a water supply valve 15 through which wash water is supplied from the outside of the cabinet 10. A detergent supply apparatus 100 is mounted at the front of the cabinet 10. A water supply hose 16 is connected between the water supply valve 15 and the detergent supply apparatus 100.

Water, introduced through the water supply valve 15, is supplied to the detergent supply apparatus 100 through the water supply hose 16. In the detergent supply apparatus 100, the water is mixed with a detergent. The mixture, i.e., wash water, is introduced into the tub 11 through a connection pipe 17.

Below the tub 11 is provided a drainage unit 18 to forcibly drain the wash water from the tub 11 out of the cabinet 10 after the completion of washing. The drainage unit 18 includes a drainage hose 18*a* and a drainage pump 18*b*.

Figure 3:
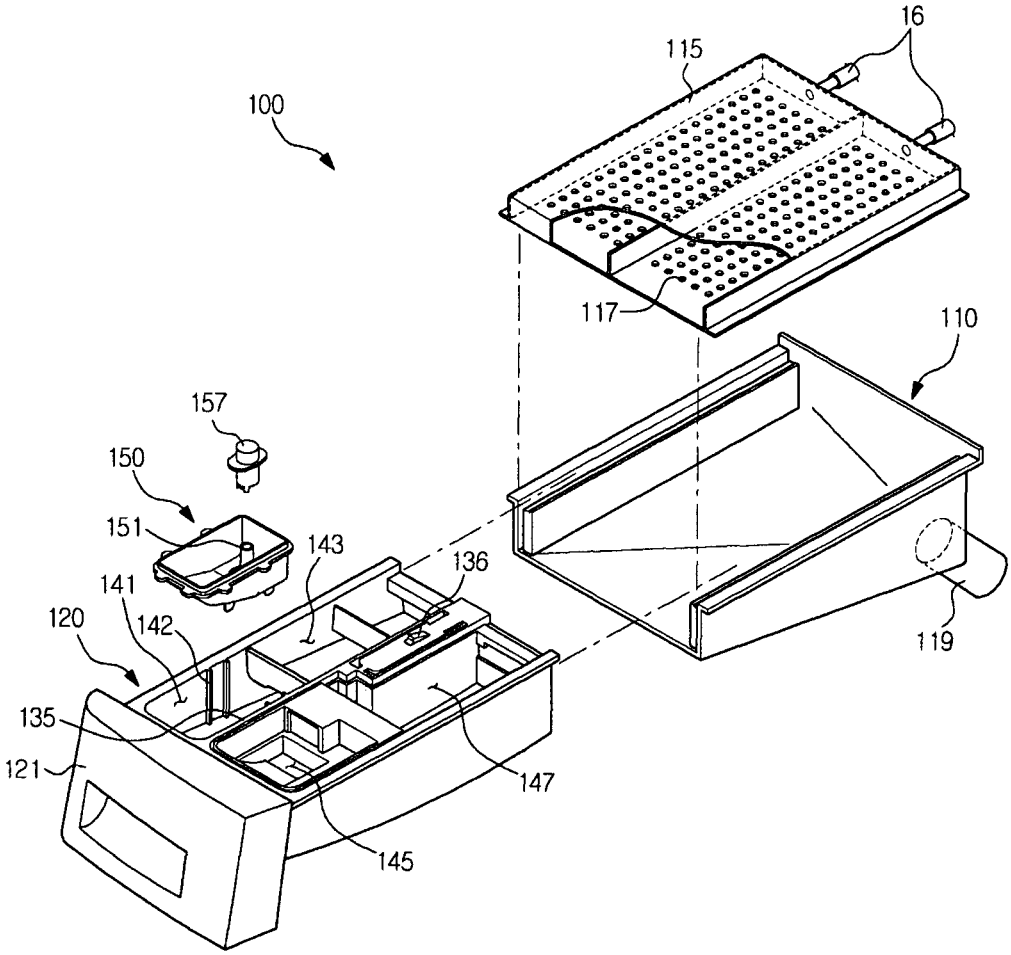
FIG. 3 is an exploded perspective view illustrating a detergent supply apparatus according to an embodiment.
Figure 4:
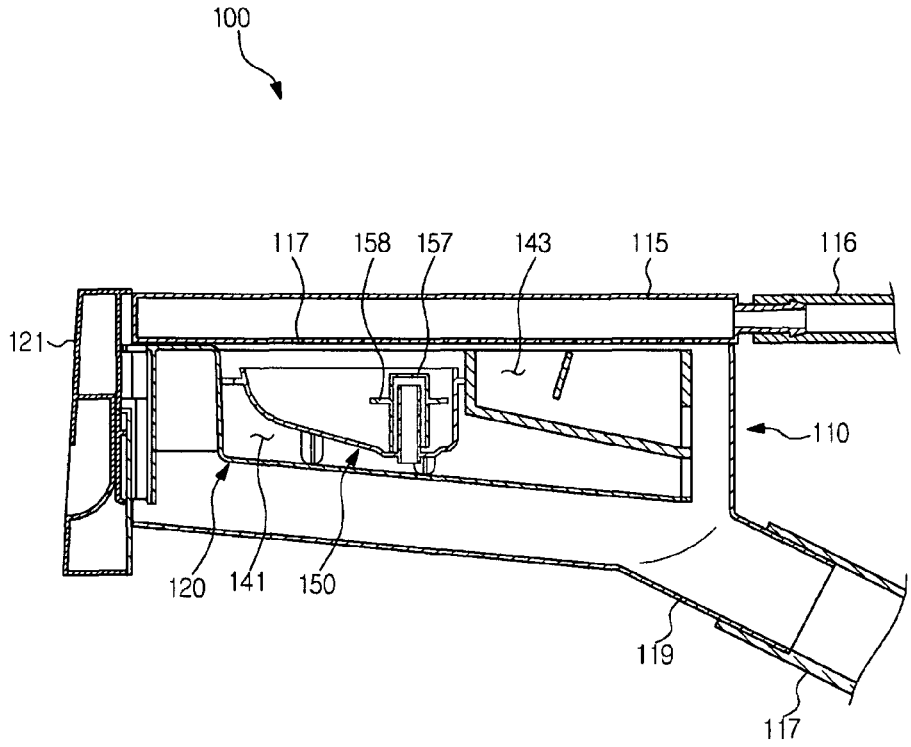
FIG. 4 is a sectional view of the detergent supply apparatus of FIG. 3.

FIG. 3 is an exploded perspective view illustrating a detergent supply apparatus 100 according to an embodiment. FIG. 4 is a sectional view of the detergent supply apparatus 100 of FIG. 3.

As shown in FIGS. 3 and 4, the detergent supply apparatus 100 includes a box-shaped housing 110 open at the front thereof and a detergent box 120 detachably coupled into the housing 110 through the open front of the housing 110.

The detergent supply apparatus 100 is disposed at the upper-side front of the cabinet 10 such that the detergent box 120 is opened and closed in a drawer fashion outside the cabinet 10.

In the housing 110 is provided a space to receive the detergent box 120. The housing 110 is open at the front and top thereof.

A water supply case 115 is coupled to the open top of the housing 110. The water supply case 115 is connected to the water supply hose 16. The water supply case 115 has a plurality of through holes 117 through which wash water is supplied to the detergent box 120.

At the rear of the housing 110 is formed an outflow port 119 through which water introduced through the through holes 117 of the water supply case 115 is supplied into the tub 11 together with a detergent contained in the detergent box 120 through the connection pipe 17.

The bottom of the housing 110 is inclined such that the detergent and the water flow to the outflow port 119. A mixture of the detergent and the water is supplied into the tub 11 through the connection pipe 17 connected to the outflow port 119.

At the front of the detergent box 120 is provided a grip 121 to allow a user to insert and withdraw the detergent box 120.

The interior of the detergent box 120 is partitioned into left and right sections by a partition 135. At the top of the partition 135 is provided a catch 136 to couple the detergent box 120 to the housing 110.

In the front part of the left section of the detergent box 120 is provided a main washing detergent containing unit 141 to contain a main washing detergent. In the rear part of the left section of the detergent box 120 is provided a reserve detergent containing unit 143 to contain a reserve detergent.

The main washing detergent containing unit 141 contains a main washing powder detergent. The bottom of the main washing detergent containing unit 141 is inclined such that a mixture of a powder detergent and water flows to the outflow port 119.

An additional liquid detergent containing unit 150 may be mounted in the main washing detergent containing unit 141. That is, a user may put a powder detergent in the main washing detergent containing unit 141 to perform washing using the powder detergent. The user may mount the liquid detergent containing unit 150 in the main washing detergent containing unit 141 and inject a liquid detergent into the liquid detergent containing unit 150 to perform washing using the liquid detergent.

In this embodiment, the liquid detergent containing unit 150 is configured in a detachable structure in which the liquid detergent containing unit 150 is fitted in guide rails 142 formed at the inner wall of the main washing detergent containing unit 141. Details of the liquid detergent containing unit 150 will be described later.

The reserve detergent containing unit 143 is provided at the upper part of the rear of the main washing detergent containing unit 141 to contain a reserve powder detergent and supply a mixture of the reserve powder detergent and water to the outflow port 119.

In the front part of the right section of the detergent box 120 is provided a rinse containing unit 145 to contain a rinse. In the rear part of the right section of the detergent box 120 is provided a decolorant containing unit 147 to contain a decolorant.

The rinse containing unit 145 contains a rinse or a fabric softener. In the rinse containing unit 145 is provided a siphon pipe (not shown) to supply the rinse to the outflow port 119 using a siphon phenomenon.

The decolorant containing unit 147 contains a decolorant. In the decolorant containing unit 147 is provided a siphon pipe (not shown) to supply the decolorant to the outflow port 119 using a siphon phenomenon.

Figure 5:
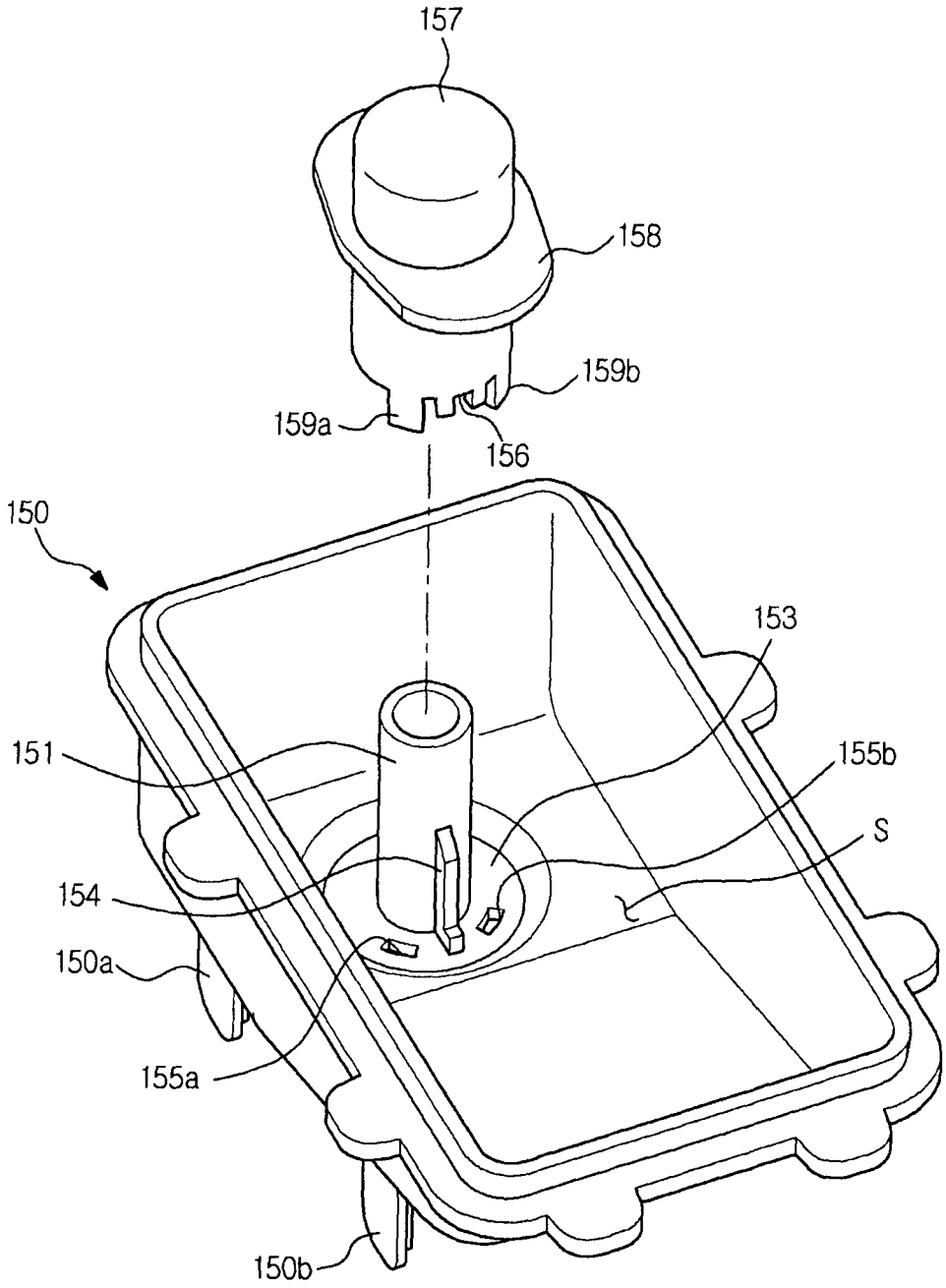
FIG. 5 is a top perspective view illustrating a liquid detergent containing unit according to an embodiment.
Figure 6:
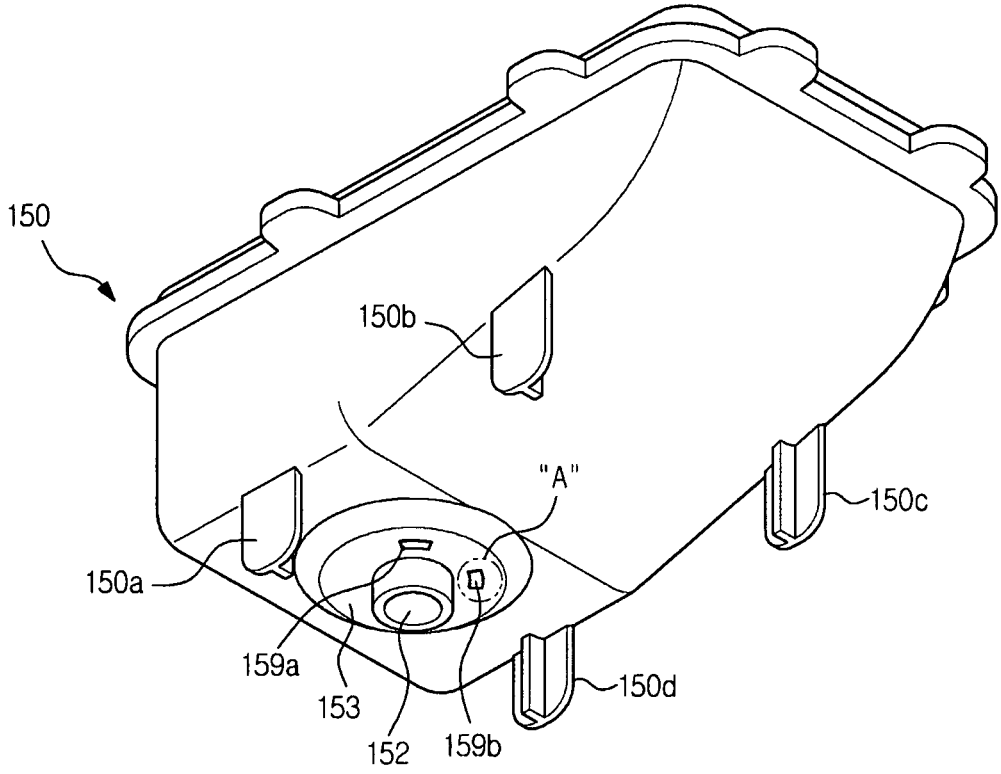
FIG. 6 is a bottom perspective view of the liquid detergent containing unit.
Figure 7:
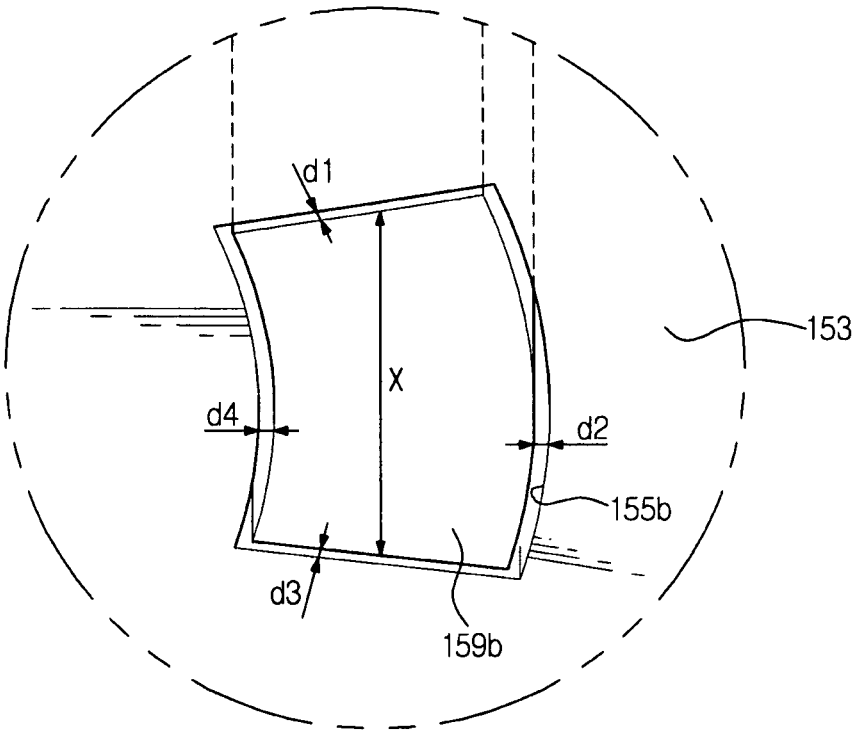
FIG. 7 is a detailed view of part "A" of FIG. 6.

FIG. 5 is a top perspective view illustrating a liquid detergent containing unit 150 according to an embodiment. FIG. 6 is a bottom perspective view of the liquid detergent containing unit 150. FIG. 7 is a detailed view of part "A" of FIG. 6.

As shown in FIGS. 5 and 6, a containing space S to contain a liquid detergent is provided in the liquid detergent containing unit 150. The liquid detergent containing unit 150 includes a siphon pipe 151 provided at the rear part of the containing space S to induce a siphon phenomenon and a siphon cap 157 coupled to the siphon pipe 151.

At opposite sides of the bottom of the liquid detergent containing unit 150 are provided detergent containing unit legs 150*a*, 150*b*, 150*c* and 150*d* to separate the containing space S from the bottom of the main washing detergent containing unit 141. A gap is defined between the liquid detergent containing unit 150 and the main washing detergent containing unit 141 by the provision of the detergent containing unit legs 150*a*, 150*b*, 150*c* and 150*d*, with the result that the detergent and the water discharged from the siphon pipe 151 due to the siphon phenomenon easily flow to the outflow port 119.

The siphon pipe 151 is provided in a siphon installation part 153 at the bottom of the liquid detergent containing unit 150. The siphon installation part 153 protrudes downward from the bottom of the liquid detergent containing unit 150 in the shape of a circle.

The siphon pipe 151 protrudes upward from the center of the siphon installation part 153. Also, the siphon pipe 151 includes an extension 152 protruding downward from the bottom of the siphon installation part 153. The extension 152 is provided to accelerate a siphon action in the containing space S.

The siphon cap 157 is coupled to the siphon pipe 151 to induce the siphon phenomenon through interaction between the siphon cap 157 and the siphon pipe 151.

The siphon cap 157 is open at the lower end thereof to surround the siphon pipe 151. The siphon cap 157 has a larger outer diameter than the siphon pipe 151.

From the side of the siphon cap 157 protrudes a limit level indicator 158 to indicate a limit injection level of a liquid detergent. The limit level indicator 158 serves to inform a user of a limit of a liquid detergent to be injected in a state in which the siphon cap 157 is coupled to the siphon pipe 151. If the level of the injected liquid detergent exceeds the limit level indicator 158, a siphon phenomenon occurs, with the result that the liquid detergent to be supplied during washing is previously discharged through the siphon pipe 151.

The coupling between the siphon pipe 151 and the siphon cap 157 is achieved by fitting a siphon guide 154 formed at the side of the siphon pipe 151 into a siphon groove 156 formed at the lower end of the siphon cap 157.

One or more residual water holes 155*a* and 155*b* are formed through the siphon installation part 153 around the siphon pipe 151. The residual water holes 155*a* and 155*b* have shapes corresponding to those of cap protrusions 159*a* and 159*b* of the siphon cap 157 such that the cap protrusions 159*a* and 159*b* are fitted in the residual water holes 155*a* and 155*b*, respectively.

The cap protrusions 159*a* and 159*b* are formed at the lower end of the siphon cap 157 such that cap protrusions 159*a* and 159*b* are fitted in the residual water holes 155*a* and 155*b*, respectively. The cap protrusions 159*a* and 159*b* protrude downward along part of the circumference of the siphon cap 157. In this embodiment, two cap protrusions 159*a* and 159*b* are provided. A line X interconnecting opposite ends of each of the cap protrusions 159*a* and 159*b* has a length of 3 mm to 7 mm. In this embodiment, the line X has a length of 5 mm.

The residual water holes 155*a* and 155*b*, in which the cap protrusions 159*a* and 159*b* are fitted, have sectional shapes corresponding to and greater than those of the cap protrusions 159*a* and 159*b*. The residual water holes 155*a* and 155*b* are equal in number to the cap protrusions 159*a* and 159*b*. One or more residual water holes 155*a* and 155*b* and one or more cap protrusions 159*a* and 159*b* are provided.

When the siphon cap 157 is coupled to the siphon pipe 151, the cap protrusions 159*a* and 159*b* are fitted into the residual water holes 155*a* and 155*b*, respectively. Between the cap protrusions 159*a* and 159*b* and the residual water holes 155*a* and 155*b* are defined one or more gaps d1, d2, d3 and d4 through which residual water is discharged from the liquid detergent containing unit 150.

The gaps d1, d2, d3 and d4 defined between the cap protrusions 159*a* and 159*b* and the residual water holes 155*a* and 155*b* are 0.05 mm to 0.5 mm. The gaps d1, d2, d3 and d4 may be 0.1 mm.

A liquid detergent has a higher viscosity than water. Consequently, the liquid detergent is not discharged through the gaps d1, d2, d3 and d4 defined between the cap protrusions 159*a* and 159*b* and the residual water holes 155*a* and 155*b*, but water is discharged through the gaps d1, d2, d3 and d4 defined between the cap protrusions 159*a* and 159*b* and the residual water holes 155*a* and 155*b*.

In the related art, the supply of a mixture of a liquid detergent and water due to a siphon phenomenon is performed only at the height corresponding to the lower end of the siphon cap, with the result that a mixture of a liquid detergent and water (most of the mixture is water) present at a level lower than the height corresponding to the lower end of the siphon cap is discharged outside only by a user emptying the liquid detergent containing unit.

In this embodiment, on the other hand, a liquid detergent injected into the liquid detergent containing unit 150 is not discharged through the gaps d1, d2, d3 and d4 defined between the cap protrusions 159*a* and 159*b* and the residual water holes 155*a* and 155*b*, and residual water (containing a small percentage of the liquid detergent) present on the siphon installation part 153 after the supply of the liquid detergent and water due to a siphon phenomenon with the progress of washing is discharged through the gaps d1, d2, d3 and d4 defined between the cap protrusions 159*a* and 159*b* and the residual water holes 155*a* and 155*b* because the residual water has a lower viscosity than the liquid detergent.

As shown in FIG. 7, the gaps d1, d2, d3 and d4 may be defined between outer sides of the cap protrusion 159*b* and inner sides of the residual water hole 155*b*. Alternatively, at least one gap may be defined between at least one of the outer sides of the cap protrusion 159*b* and at least one of the inner sides of the residual water hole 155*b*. In this case, d1 and d2 may be 0.1 mm and d3 and d4 may be 0 mm.

Also, the gaps d1, d2, d3 and d4 may have the same size or different sizes. In this case, the gaps d1, d2, d3 and d4 may be 0.05 mm to 0.5 mm.

In this embodiment, the cap protrusions 159*a* and 159*b* are provided at the lower end of the siphon cap 157. Alternatively, the cap protrusions 159*a* and 159*b* may be configured as hole insertion parts which are inserted into the residual water holes 155*a* and 155*b*. The hole insertion parts may not be included in the siphon cap 157. The hole insertion parts may be included as an arbitrary component of the liquid detergent containing unit 150 or provided as an independent component as long as the hole insertion parts are inserted into the residual water holes 155*a* and 155*b* to define the gaps d1, d2, d3 and d4 therebetween.

Hereinafter, a process of discharging residual water from the liquid detergent containing unit 150 according to an embodiment of the present invention will be described.

When a user wishes to perform washing using a liquid detergent, the user mounts the liquid detergent containing unit 150 in the main washing detergent containing unit 141 and injects the liquid detergent into the liquid detergent containing unit 150. At this time, the liquid detergent is injected so as not to exceed the limit level indicator 158.

In a state in which only the liquid detergent is injected, the liquid detergent is not discharged through the gaps d1, d2, d3 and d4 defined between the cap protrusions 159*a* and 159*b* and the residual water holes 155*a* and 155*b* because the viscosity of the liquid detergent is high. Also, a siphon phenomenon does not occur.

With the progress of washing, water introduced through the water supply valve 15 and the water supply hose 16 is supplied into the detergent box 120 through the water supply case 115. The water is mixed with the liquid detergent in the liquid detergent containing unit 150. As the level of the mixture of the liquid detergent and the water rises, the mixture exceeds the upper end of the siphon pipe 151, with the result that a siphon phenomenon occurs. Consequently, the mixture is discharged through the siphon pipe 151 and flows to the outflow port 119.

The supply of the mixture of the liquid detergent and the water due to the siphon phenomenon is performed only at the height (i.e., the height from the siphon installation part 153 to the lower end of the siphon cap 157) corresponding to the lower end of the siphon cap 157, and the mixture of the liquid detergent and the water (most of the mixture is water) may be present on the siphon installation part 153 at a level lower than the height corresponding to the lower end of the siphon cap. Such residual water is discharged through the gaps d1, d2, d3 and d4 defined between the cap protrusions 159*a* and 159*b* and the residual water holes 155*a* and 155*b*, with the result that no residual water is present in the liquid detergent containing unit 150.

That is, the residual water holes 155*a* and 155*b*, the cap protrusions 159*a* and 159*b*, and the gaps d1, d2, d3 and d4 defined between the residual water holes 155*a* and 155*b* and the cap protrusions 159*a* and 159*b* constitute a residual water removal unit to remove residual water from the liquid detergent containing unit 150. In addition, the gaps d1, d2, d3 and d4 defined between the residual water holes 155*a* and 155*b* and the cap protrusions 159*a* and 159*b* serve as a residual water discharge unit constituting residual water discharge channels.

That is, the gaps d1, d2, d3 and d4 defined between the residual water holes 155*a* and 155*b* and the cap protrusions 159*a* and 159*b* constitute a water selection unit to select only water such that only the water passes therethrough, the residual water holes 155*a* and 155*b* serve as selection holes 155*a* and 155*b* to select water, and the gaps d1, d2, d3 and d4 defined between the residual water holes 155*a* and 155*b* and the cap protrusions 159*a* and 159*b* serve as a selection gap unit to allow only water to pass therethrough.

During steam washing or drying in addition to washing, steam is generated in the tub 11, and the steam flows back to be collected in the liquid detergent containing unit 150 in the form of water. Such residual water is discharged through the gaps d1, d2, d3 and d4 defined between the cap protrusions 159*a* and 159*b* and the residual water holes 155*a* and 155*b*, with the result that no residual water is present in the liquid detergent containing unit 150.

The structure in which the residual water is discharged from the liquid detergent containing unit 150 through the gaps d1, d2, d3 and d4 defined between the cap protrusions 159*a* and 159*b* and the residual water holes 155*a* and 155*b* may be applied to all kinds of liquid detergent containing units to supply liquid detergents using a siphon phenomenon.

Hereinafter, a detergent supply apparatus according to another embodiment of the present invention will be described. The same components of this embodiment as those of the previous embodiment will not be described.

Figure 8:
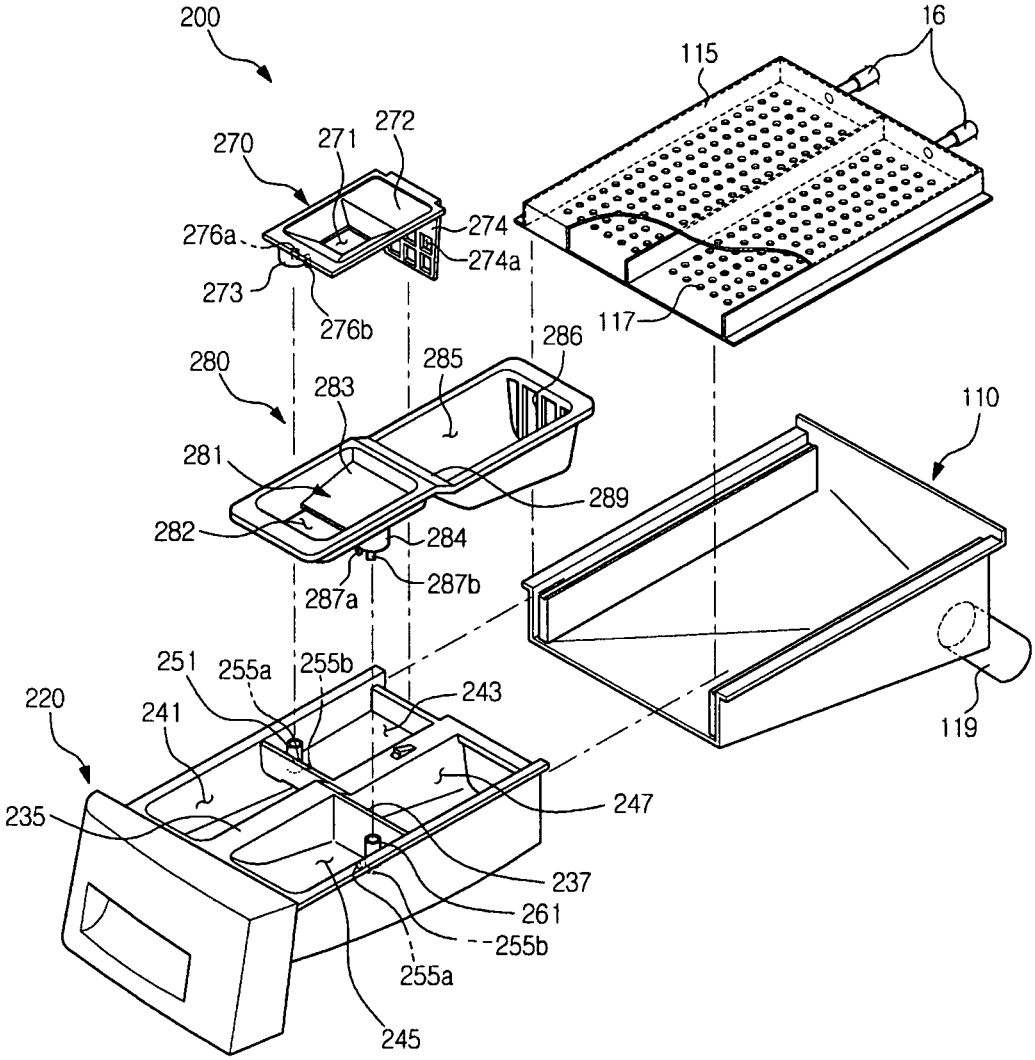
FIG. 8 is an exploded perspective view illustrating a detergent supply apparatus according to another embodiment.

FIG. 8 is an exploded perspective view illustrating a detergent supply apparatus 200 according to another embodiment of the present invention.

As shown in FIG. 8, the detergent supply apparatus 200 includes a box-shaped housing 110 open at the front thereof and a detergent box 220 detachably coupled into the housing 110 through the open front of the housing 110.

The housing 110 and a water supply case 115 coupled to the housing 110 have the same structures as those of the previous embodiment.

In the previous embodiment, the liquid detergent containing unit 150 is detachably mounted in the detergent box 120. In this embodiment, liquid detergent containing units 243 and 245 are integrally formed in the detergent box 220. That is, a first liquid detergent containing unit 243 and a second liquid detergent containing unit 245 are integrally mounted in the detergent box 220, which will be hereinafter described in detail.

The interior of the detergent box 220 is partitioned into a plurality of sections by partitions 235 and 237 such that different kinds of detergents are contained in the respective sections.

The first partition 235 partitions the interior of the detergent box 220 into left and right sections.

In the left section of the detergent box 220 is provided a powder detergent containing unit 241 to contain a main washing powder detergent.

In the rear upper part of the powder detergent containing unit 241 is provided a first liquid detergent containing unit 243 to contain a main washing liquid detergent.

The first liquid detergent containing unit 243 is integrally formed in the powder detergent containing unit 241.

The first liquid detergent containing unit 243 is separated from the bottom of the powder detergent containing unit 241 by a predetermined distance such that a powder detergent flows to the outflow port 119 together with water.

In the first liquid detergent containing unit 243 is provided a first siphon pipe 251 to induce a siphon action. The first siphon pipe 251 is formed such that a mixture of a detergent and water flows to the outflow port 119 through a channel defined in the center of the first siphon pipe 251.

To the first siphon pipe 251 is coupled a cap liquid unit 270 to induce a siphon action.

Consequently, the main washing liquid detergent in the first liquid detergent containing unit 243 flows to the powder detergent containing unit 241 through the internal channel of the first siphon pipe 251 and is supplied to the outflow port 119 of the housing 110.

The cap liquid unit 270 includes a unit body 272 having a supply hole 271 to supply a liquid detergent, a first siphon cap 273 formed at one side of the bottom of the unit body 272, and a foreign matter filter 274.

The first siphon cap 273 is formed in the shape of a cylinder closed at the top thereof to surround the first siphon pipe 251 of the first liquid detergent containing unit 243.

The foreign matter filter 274 is bent downward from the side of the unit body 272 opposite to the first siphon cap 273. The foreign matter filter 274 has a plurality of through holes 274*a* having a predetermined width to filter foreign matter when discharging a detergent and water.

In the same manner as the previous embodiment, the first siphon cap 273 is provided with first cap protrusions 276*a* and 276*b*, and the first liquid detergent containing unit 243 is provided at the bottom thereof with first residual water holes 255*a* and 255*b*, which are fitted in the first cap protrusions 276*a* and 276*b*, respectively. Between the first cap protrusions 276*a* and 276*b* and the first residual water holes 255*a* and 255*b* are defined gaps (not shown) through which residual water is discharged from the first liquid detergent containing unit 243.

The size and shape of the gaps defined between the first cap protrusions 276*a* and 276*b* and the first residual water holes 255*a* and 255*b* are the same as those of the previous embodiment. Also, the principle and process of discharging residual water through the gaps defined between the first cap protrusions 276*a* and 276*b* and the first residual water holes 255*a* and 255*b* are the same as those of the previous embodiment.

The right section of the detergent box 220 is partitioned into two sections by the second partition 237.

In the front right section of the detergent box 220 is provided a second liquid detergent containing unit 245 to contain a rinse or a fabric softener. In the rear right section of the detergent box 220 is provided a mounting space 247 in which a reserve detergent containing unit 285, which will be described later, is mounted.

The second liquid detergent containing unit 245 is integrally formed in the detergent box 220 to contain a rinse or a decolorant.

In the second liquid detergent containing unit 245 is provided a second siphon pipe 261 to induce a siphon action. The second siphon pipe 261 is formed such that a mixture of a detergent and water flows to the outflow port 119 of the housing 110 through a channel defined in the center of the second siphon pipe 261.

A rinse cap 280 is coupled to the tops of the second liquid detergent containing unit 245 and the mounting space 247.

The rinse cap 280 includes a rinse injection unit 281 to inject a rinse and a reserve detergent containing unit 285 to contain a reserve washing powder detergent.

The rinse injection unit 281 of the rinse cap 280 is coupled to the second liquid detergent containing unit 245 of the detergent box 220. The reserve detergent containing unit 285 is coupled to the mounting space 247.

The rinse injection unit 281 and the reserve detergent containing unit 285 are connected to each other through a connection part 289.

The rinse injection unit 281 includes a rinse injection hole 282 to inject a rinse, a rinse injection plate 283 forming the rinse injection hole 282, and a second siphon cap 284 protruding downward from one side of the rinse injection plate 283.

The second siphon cap 284 is formed in the shape of a cylinder closed at the top thereof to surround the second siphon pipe 261. The second siphon cap 284 has a larger diameter than the second siphon pipe 261 such that a channel is defined between the inner circumference of the second siphon cap 284 and the outer circumference of the second siphon pipe 261.

The reserve detergent containing unit 285 has a size sufficient to be fitted in the mounting space 247. At the rear of the reserve detergent containing unit 285 is formed a detergent discharge port 35 through which a reserve detergent is discharged.

In the same manner as the previous embodiment, the second siphon cap 284 is provided with second cap protrusions 287*a* and 287*b*, and the second liquid detergent containing unit 245 is provided at the bottom thereof with second residual water holes 265*a* and 265*b*, which are fitted in the second cap protrusions 287*a* and 287*b*, respectively. Between the second cap protrusions 287*a* and 287*b* and the second residual water holes 265*a* and 265*b* are defined gaps (not shown) through which residual water is discharged from the second liquid detergent containing unit 245.

The size and shape of the gaps defined between the second cap protrusions 287*a* and 287*b* and the second residual water holes 265*a* and 265*b* are the same as those of the previous embodiment. Also, the principle and process of discharging residual water through the gaps defined between the second cap protrusions 287*a* and 287*b* and the second residual water holes 265*a* and 265*b* are the same as those of the previous embodiment.

Hereinafter, a liquid detergent containing unit according to another embodiment of the present invention will be described. The same components of this embodiment as those of the previous embodiment will not be described.

Figure 9:
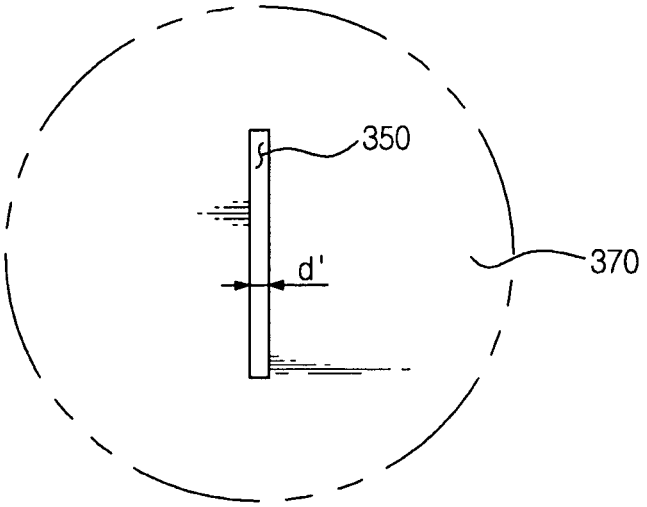
FIG. 9 is a detailed bottom view illustrating a liquid detergent containing unit according to another embodiment.

FIG. 9 is a detailed bottom view illustrating a liquid detergent containing unit according to another embodiment.

In the previous embodiments, residual water is selectively discharged from the liquid detergent containing units 150, 243 and 245 through the gaps d1, d2, d3 and d4 defined between the cap protrusions 159*a*, 159*b*, 276*a*, 276*b*, 287*a* and 287*b* and the residual water holes 155*a*, 155*b*, 255*a*, 255*b*, 265*a* and 265*b*. In this embodiment, a residual water discharge slit 350 may be provided instead of the gaps d1, d2, d3 and d4 defined between the cap protrusions 159*a*, 159*b*, 276*a*, 276*b*, 287*a* and 287*b* and the residual water holes 155*a*, 155*b*, 255*a*, 255*b*, 265*a* and 265*b*.

That is, the cap protrusions 159*a*, 159*b*, 276*a*, 276*b*, 287*a* and 287*b* are not fitted in the residual water holes 155*a*, 155*b*, 255*a*, 255*b*, 265*a* and 265*b*, but the residual water discharge slit 350 selectively discharges residual water excluding a liquid detergent. Consequently, the residual water discharge slit 350 performs the same function as the gaps d1, d2, d3 and d4 defined between the cap protrusions 159*a*, 159*b*, 276*a*, 276*b*, 287*a* and 287*b* and the residual water holes 155*a*, 155*b*, 255*a*, 255*b*, 265*a* and 265*b* in the previous embodiments.

In this case, the residual water discharge slit 350 may be disposed at any position of the bottom 370 of the liquid detergent containing unit. The residual water discharge slit 350 may be disposed at the lowest position of the bottom 370 of the liquid detergent containing unit since residual water is present at the lowest height of the liquid detergent containing unit. In a structure in which the bottom 370 of the liquid detergent containing unit is inclined, the residual water discharge slit 350 is disposed at the lower part of the inclined bottom 370.

The residual water discharge slit 350 may have a width d' of 0.05 mm to 0.5 mm. The width d' may be 0.1 mm.

As is apparent from the above description, residual water is discharged from the liquid detergent containing unit through the gaps defined between the residual water holes and the cap protrusions in the detergent supply apparatus and the washing machine having the same.

Also, the interior of the liquid detergent containing unit is kept clean.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A detergent supply apparatus comprising:

a detergent box; and at least one liquid detergent containing unit provided in the detergent box to move a liquid detergent using a siphon phenomenon, wherein the liquid detergent containing unit comprises a siphon pipe to induce a siphon action, a siphon cap coupled to the siphon pipe, and at least one residual water hole formed through a bottom of the liquid detergent containing unit, the siphon cap comprises at least one cap protrusion fitted into the residual water hole, and at least one gap is defined between the residual water hole and the cap protrusion when the at least one cap protrusion is fitted into the at least one residual water hole, the gap being dimensioned such that residual water is discharged from the liquid detergent containing unit through the gap and the liquid detergent is not discharged through the gap.

2. The detergent supply apparatus according to claim 1, wherein the cap protrusion protrudes downward along part of a circumference of the siphon cap, and the residual water hole has a shape corresponding to that of the cap protrusion.

3. The detergent supply apparatus according to claim 2, wherein the gap is defined between at least one outer side of the cap protrusion and at least one inner side of the residual water hole.

4. The detergent supply apparatus according to claim 2, wherein the cap protrusion has a length of about 3 mm to about 7 mm between opposite ends thereof.

5. The detergent supply apparatus according to claim 1, wherein the siphon pipe is disposed at a center of a siphon installation part protruding downward from the bottom of the liquid detergent containing unit, and the residual water hole is disposed at the siphon installation part at which the cap protrusion is mounted.

6. The detergent supply apparatus according to claim 1, wherein the gap has a size of about 0.05 mm to about 0.5 mm.

7. The detergent supply apparatus according to claim 1, wherein the siphon pipe protrudes downward from the bottom of the liquid detergent containing unit to accelerate the siphon action.

8. The detergent supply apparatus according to claim 1, wherein the liquid detergent containing unit comprises a separation type liquid detergent containing unit detachably provided in the detergent box.

9. The detergent supply apparatus according to claim 1, wherein the liquid detergent containing unit comprises at least one integral liquid detergent containing unit integrally provided in the detergent box.

10. The detergent supply apparatus according to claim 9, wherein the integral liquid detergent containing unit comprises a main washing liquid detergent containing unit to contain a main washing liquid detergent, the siphon cap comprises a cap liquid unit coupled to the siphon pipe, and the cap liquid unit comprises a unit body having a supply hole to inject a liquid detergent, a first siphon cap provided at a bottom of the unit body, the first siphon cap being coupled to the siphon pipe, and a foreign matter filter extending downward from one end of the unit body.

11. The detergent supply apparatus according to claim 9, wherein the integral liquid detergent containing unit comprises a rinse containing unit to contain a rinse or a decolorant, the siphon cap comprises a rinse cap coupled to the siphon pipe, the rinse cap comprises a rinse injection unit to inject a rinse and a reserve detergent containing unit to contain a reserve detergent, and the rinse injection unit comprises a second siphon cap provided at a bottom thereof, the second siphon cap being coupled to the siphon pipe.

12. The detergent supply apparatus according to claim 11, wherein the reserve detergent containing unit is integrally formed at a rear of the rinse cap.

13. A washing machine comprising:

a cabinet;

a detergent box detachably coupled into one side of the cabinet; and at least one liquid detergent containing unit provided in the detergent box to move a liquid detergent using a siphon phenomenon, wherein the liquid detergent containing unit comprises a siphon pipe to induce a siphon action, a siphon cap coupled to the siphon pipe, and a residual water removal unit to remove residual water from the liquid detergent containing unit, and the residual water removal unit comprises at least one residual water hole formed through a bottom of the liquid detergent containing unit, at least one cap protrusion provided at the siphon cap such that the cap protrusion is fitted into the residual water hole, and at least one residual water discharge unit formed between the residual water hole and the cap protrusion, when the at least one cap protrusion is fitted into the residual water hole, to function as a discharge channel through which residual water is discharged and the liquid detergent is not discharged.

14. The washing machine according to claim 13, wherein the cap protrusion protrudes downward along part of a circumference of the siphon cap, and the residual water hole has a shape corresponding to that of the cap protrusion.

15. The washing machine according to claim 14, wherein the cap protrusion has a length of about 3 mm to about 7 mm between opposite ends thereof.

16. The washing machine according to claim 13, wherein the residual water discharge unit is formed between at least one outer side of the cap protrusion and at least one inner side of the residual water hole.

17. The washing machine according to claim 13, wherein a gap defined between at least one inner side of the residual water hole and at least one outer side of the cap protrusion has a size of about 0.05 mm to about 0.5 mm.

18. The washing machine according to claim 13, wherein the siphon pipe protrudes downward from the bottom of the liquid detergent containing unit to accelerate the siphon action.

19. A detergent supply apparatus comprising:

a detergent box; and at least one liquid detergent containing unit provided in the detergent box to move a liquid detergent using a siphon phenomenon, wherein the liquid detergent containing unit comprises at least one residual water hole formed through a bottom thereof and at least one hole insertion part inserted into the residual water hole, and at least one gap is defined between the residual water hole and the hole insertion part when the at least one cap protrusion is fitted into the at least one residual water hole, the gap being dimensioned such that residual water is discharged from the liquid detergent containing unit through the gap and the liquid detergent is not discharged through the gap.

20. The detergent supply apparatus according to claim 19, wherein the gap has a size of about 0.05 mm to about 0.5 mm.

21. The detergent supply apparatus according to claim 19, wherein the gap is defined between at least one outer side of the hole insertion part and at least one inner side of the residual water hole.

22. The detergent supply apparatus according to claim 19, wherein the liquid detergent containing unit further comprises a siphon pipe to induce a siphon action and a siphon cap coupled to the siphon pipe, and the hole insertion part is formed at a lower part of the siphon cap.

* * * * *

UNITED STATES PATENT AND TRADEMARK OFFICE

CERTIFICATE OF CORRECTION

PATENT NO. : 8,826,700 B2
APPLICATION NO. : 12/926162
DATED : September 9, 2014
INVENTOR(S) : Jin Doo Kim It is certified that error appears in the above-identified patent and that said Letters Patent is hereby corrected as shown below:

On the Title Page

Column 1, Line 1, Item [75] (Inventor), Delete "Gyionggi-do" and insert -- Gyeonggi-do --, therefor.

Signed and Sealed this
Twenty-third Day of December, 2014

Michelle K. Lee

Michelle K. Lee
*Deputy Director of the United States Patent and Trademark Office*